US011815255B2

(12) United States Patent
Zhang

(10) Patent No.: US 11,815,255 B2
(45) Date of Patent: Nov. 14, 2023

(54) LAMP

(71) Applicant: Yi Zhang, Ganzhou (CN)

(72) Inventor: Yi Zhang, Ganzhou (CN)

( * ) Notice: Subject to any disclaimer, the term of this patent is extended or adjusted under 35 U.S.C. 154(b) by 0 days.

(21) Appl. No.: 18/151,454

(22) Filed: Jan. 8, 2023

(65) Prior Publication Data

US 2023/0151957 A1 May 18, 2023

(51) Int. Cl.

| | |
|---|---|
| ***F21V 33/00*** | (2006.01) |
| ***F21S 6/00*** | (2006.01) |
| ***F21V 31/00*** | (2006.01) |
| *F21Y 115/10* | (2016.01) |
| *F21W 121/00* | (2006.01) |

(52) U.S. Cl.

CPC ..... *F21V 33/0056* (2013.01); *F21S 6/004* (2013.01); *F21V 31/00* (2013.01); *F21W 2121/00* (2013.01); *F21Y 2115/10* (2016.08)

(58) Field of Classification Search

CPC ... F21V 33/0056; F21V 31/00; F21Y 2115/10
See application file for complete search history.

(56) References Cited

U.S. PATENT DOCUMENTS

| | | | | |
|---|---|---|---|---|
| 6,416,197 | B1 * | 7/2002 | Chang | F21S 6/002 362/253 |
| 6,447,137 | B1 * | 9/2002 | Long | F21S 10/002 362/240 |
| 2018/0283631 | A1 * | 10/2018 | Lian | F21V 23/02 |
| 2019/0338901 | A1 * | 11/2019 | Ray | F21S 6/001 |

* cited by examiner

*Primary Examiner* — Gerald J Sufleta, II

(57) ABSTRACT

The utility model provides an ornamental lamp with a new structure, comprising a lamp body and a water pump, wherein the lamp body is provided with a cavity, liquid and ornamental objects are arranged in the cavity, a water inlet and a water outlet communicating with the cavity are respectively arranged on the lamp body, at least part of the side wall of the lamp body is transparent or semitransparent; the water pump is provided with a water inlet end and a water outlet end, the water inlet end communicates with the water inlet, and the water outlet end communicates with the water outlet. The ornamental lamp of the utility model has a simpler and more efficient structure and a longer service life, and the moving ornamental object is more ornamental.

7 Claims, 3 Drawing Sheets

LAMP

TECHNICAL FIELD

The utility model relates to the technical field of ornamental lamps, in particular to an ornamental lamp.

BACKGROUND ART

Liquid can be filled in the cavity of the lamp body for the ornamental lamp, some ornamental objects such as simulated ornamental objects and electronic fishes can be put into the liquid, and then the liquid flows in the cavity so that the ornamental objects can move in the cavity.

Generally, a wind wheel is installed in the motor outside the container, a magnet is arranged on the wind wheel, a wind blade is installed inside the container, a magnet is also arranged on the wind blade, and the wind wheel drives the wind blade to rotate through the magnetic attraction relationship to achieve water flowing in the container. However, this method has the problems of high motor rotation noise, short service life, sealing uncontrollability, etc.

SUMMARY OF THE UTILITY MODEL

The utility model provides an ornamental lamp to solve the technical problem mentioned in the background art.

The technical proposal adopted by the utility model relates to an ornamental lamp, comprising:

- a lamp body, which is provided with a cavity, the cavity is used for holding liquid and ornamental objects, a water inlet and a water outlet communicating with the cavity are respectively arranged on the lamp body, at least part of the side wall of the lamp body is transparent or semitransparent; and
- a water pump, which is provided with a water inlet end and a water outlet end, the water inlet end communicates with the water inlet, and the water outlet end communicates with the water outlet.

As a preferred embodiment of the utility model, an accommodating cavity is formed at one end of the lamp body, the water inlet and the water outlet respectively communicate with the accommodating cavity, and the water pump is arranged in the accommodating cavity.

As a preferred embodiment of the utility model, an accommodating groove is formed integrally at one end of the lamp body and forms the accommodating cavity, and an opening on the accommodating groove forms the water inlet and the water outlet.

As a preferred embodiment of the utility model, a stop piece is also arranged on the accommodating groove, and the water inlet and the water outlet are respectively arranged on the stop piece.

As a preferred embodiment of the utility model, the stop piece is connected with the light body by snap fit so that the stop piece is fixed on the accommodating groove.

As a preferred embodiment of the utility model, the ornamental lamp also comprises a sound generator, which is arranged on one side of the side wall of the lamp body away from the cavity and is used to play sound.

As a preferred embodiment of the utility model, the ornamental lamp also comprises a base, which is provided with a mounting cavity, the lamp body is arranged on the base, and the sound generator is arranged in the mounting cavity.

As a preferred embodiment of the utility model, a fixing structure is also arranged on the inner side of the base away from the lamp body, the sound generator is arranged on the fixing structure, a flare opening is arranged at one end of the base away from the lamp body and corresponding to the position of the sound generator, and a speaker mesh is arranged at the flare opening.

As a preferred embodiment of the utility model, an LED lamp is arranged outside one end of the lamp body and irradiates toward the cavity, and the side wall at least corresponding to the LED lamp area on the lamp body is a transparent structure.

As a preferred embodiment of the utility model, a supporting block is also arranged outside one end of the base away from the lamp body and enables the speaker mesh to be far away from an external supporting platform.

DESCRIPTION OF DRAWINGS

In order to explain the technical proposal in the embodiments of the utility model more clearly, the drawings to be used in the embodiments or in the description of the prior art are briefly introduced below. Obviously, the drawings in the description below are only some embodiments of the utility model. For ordinary technician in the field, other drawings can be obtained from these drawings without creative labor.

REFERENCE SIGNS FOR DRAWINGS

Figure 1:
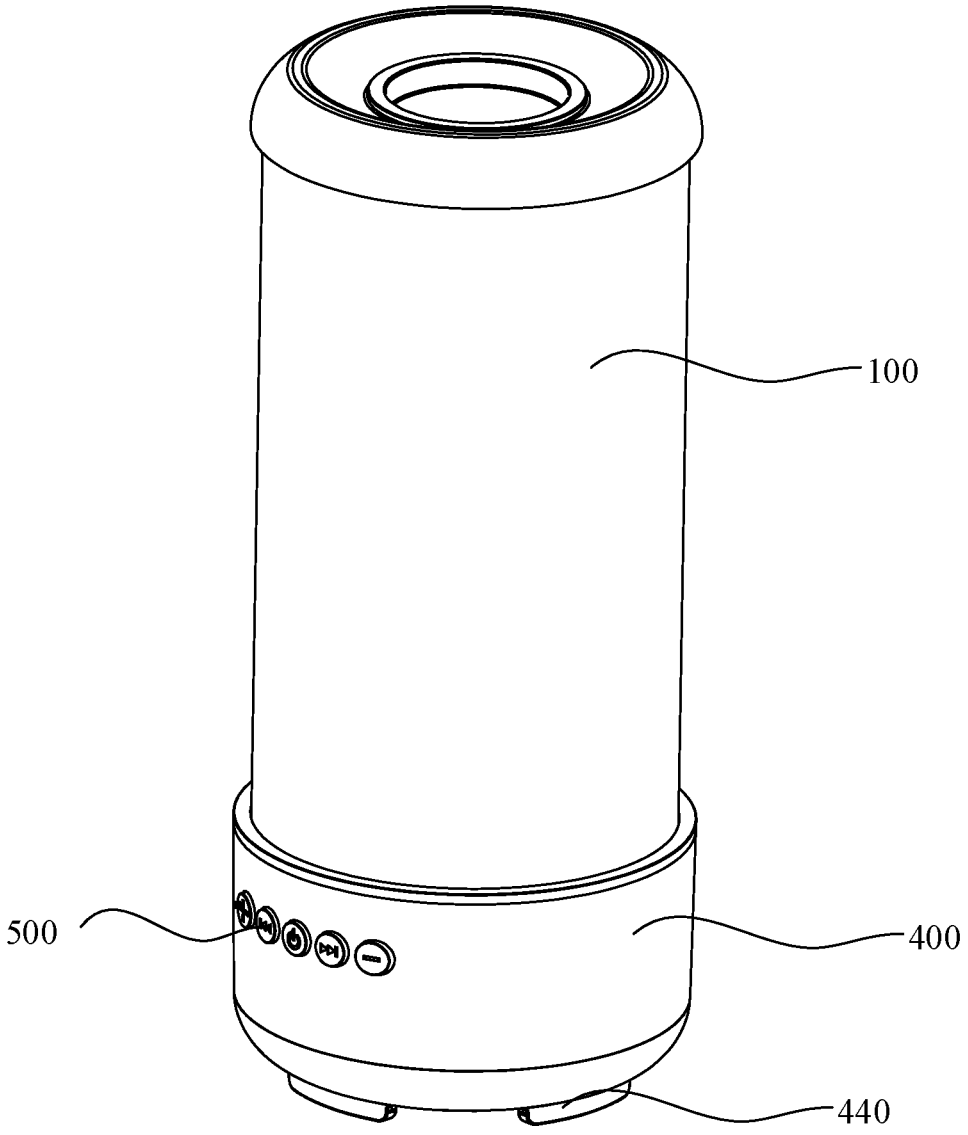
FIG. 1 is the structural diagram of an ornamental lamp provided by the utility model.

100. lamp body; 110. water inlet; 120. cavity; 130. bushing; 140. accommodating groove; 150. stop piece; 160. seal cover; 170*a*. upper cover; 170*b*. sleeve; 170*c*. lower cover; 180. assembly groove;

200. water pump; 300. LED lamp;

400. base; 410. mounting cavity; 420. fixing structure; 430. flare opening; 440. supporting block;

500. button; 600. sound generator; 700. speaker mesh.

EMBODIMENTS

In order to make the technical problems to be solved, technical proposal and beneficial effects in the utility model clearer, the utility model is further explained in detail in combination with the drawings and embodiments. It should be understood that the embodiments described herein are only used to explain the utility model and are not used to define the utility model.

It should be noted that when a component is said to be "fixed to" or "arranged on" another component, the former can be directly or indirectly on the latter. When a component is said to be "connected to" another component, the former may be connected directly or indirectly to the latter.

It should be understood that the orientation or position relationship indicated by "length", "width", "upper", "lower", "front", "rear", "left", "right", "vertical", "horizontal", "top", "bottom", "inner", "outer" and other terms is based on the orientation or position relationship shown in the drawings, which is only for the convenience of describing and simplifying the description of the utility model, not for indicating or implying that the device or element referred to must have a specific orientation or be constructed and operated in a specific orientation, and therefore cannot be understood as a limitation to the utility model.

Furthermore, the terms "first" and "second" are used for descriptive purposes only and cannot be understood as indicating or implying relative importance or implicitly indicating the number of technical features indicated. Thus, a feature defined as "first" or "second" may explicitly or implicitly include one or more of such features. In the description of some utility models, the meaning of "a plurality of" is two or more unless otherwise expressly specified.

The utility model provides an ornamental lamp, liquid and ornamental objects can be filled in the cavity, and the ornamental lamp can be used for people to view by making ornamental objects such as simulated jellyfishes and electronic fishes swim in the liquid.

Figure 2:
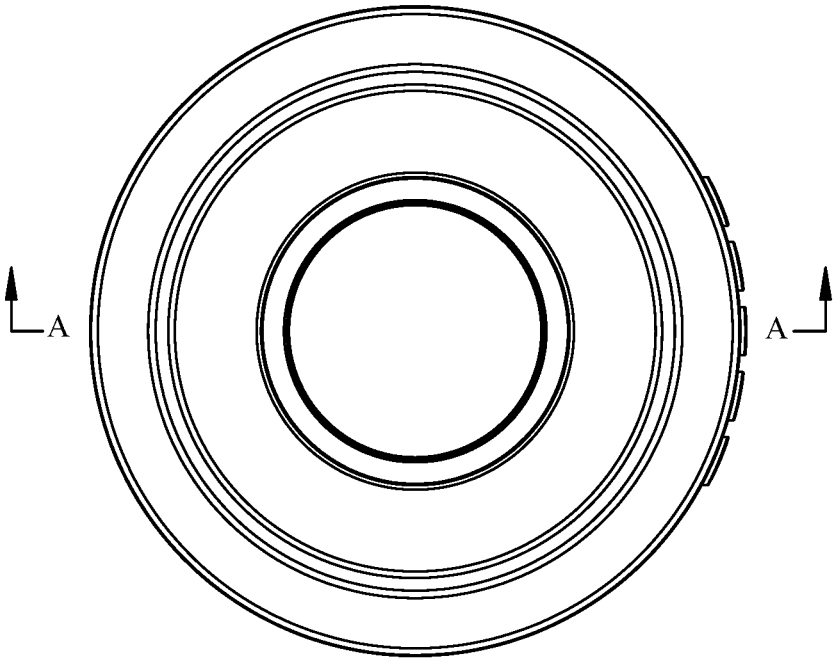
FIG. 2 is the top view of an ornamental lamp provided by the utility model.
Figure 3:
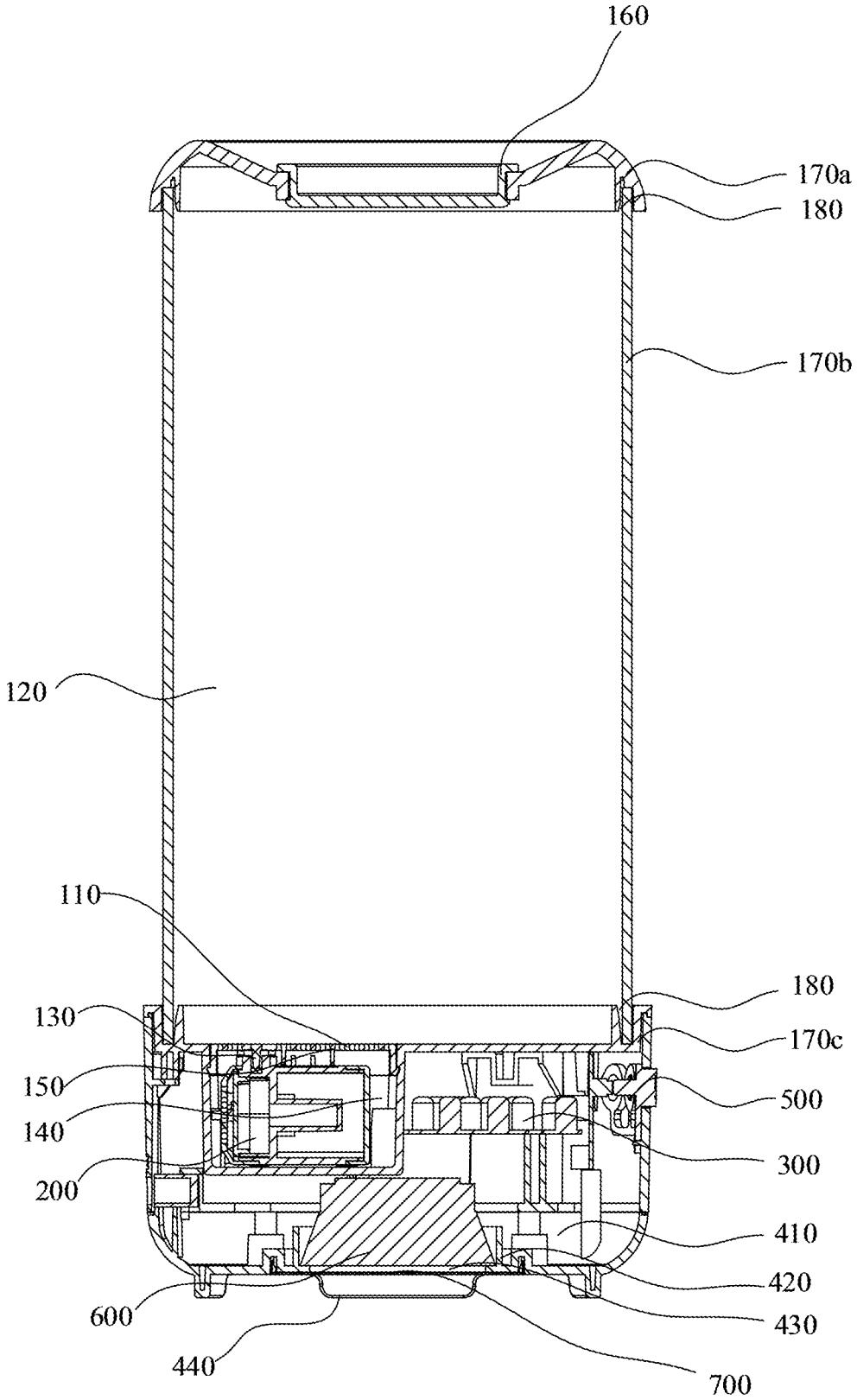
FIG. 3 is the section view at A-A shown in FIG. 2.

Refer to FIG. 1 to FIG. 3. An ornamental lamp comprises a lamp body 100, a water flow generator and a sound generator 600.

Wherein, the lamp body 100 is provided with a cavity 120, and cavity 120 is used to hold liquid and jellyfishes.

Furthermore, at least part of the side wall of the lamp body 100 is transparent or semitransparent to facilitate viewing of the jellyfishes in the cavity 120.

Specifically, in some embodiments, part of the lamp body 100 other than the upper and lower ends is transparent or semitransparent. In other embodiments, the entire lamp body 100 can be transparent or semitransparent.

The water flow generator acts on the liquid in the cavity 120 and enables the liquid in the cavity 120 to flow, allowing the jellyfishes to float up and down.

The sound generator 600 is arranged on one side of the side wall of the lamp body 100 away from the cavity 120, and is used to play sound.

Specifically, the sound generator 600 can be arranged at any position on one side of the side wall of the lamp body 100 away from the cavity 120, as long as the sound generator 600 can produce sound normally. For example, the sound generator 600 can be arranged at the bottom, side or top of the lamp body 100.

When users enjoy, the sound generator 600 can generate the sounds of wind, flowing water, thunder, waves and seagulls and other sounds to improve user's viewing experience.

It can be seen that the ornamental lamp of the utility model can improve the user's viewing experience by arranging the sound generator 600 on one side of the side wall of the lamp body 100 away from the cavity 120, so that the user can hear the sounds matched with the ornamental objects such as white noise or music while the ornamental objects swim in the liquid.

Further, in order to facilitate the installation of the sound generator 600, the ornamental lamp may also comprise a base 400, which is provided with a mounting cavity 410, the lamp body 100 is arranged on the base 400, and the sound generator 600 is arranged in the mounting cavity 410.

Even further, a fixing structure 420 is arranged on the inner side of the base 400 away from the lamp body 100, the sound generator 600 is arranged on the fixing structure 420, a flare opening 430 is arranged at one end of the base 400 away from the lamp body 100 and corresponding to the position of the sound generator 600, and a speaker mesh 700 is arranged at the flare opening 430.

In other words, the sound generator 600 is arranged at one end of the base 400 away from the lamp body 100 in the above structure, the flare opening 430 is arranged at one end of the base 400 away from the lamp body 100 and corresponding to the sound generator 600. On the one hand, the sound quality of the sound generator 600 can be improved. On the other hand, the sound output port of the sound generator 600 is hidden at the bottom, which makes the unity of the ornamental lamp better. In addition, the speaker mesh 700 can prevent dust and other impurities from entering the mounting cavity 410 through the flare opening 430.

Specifically, in order to facilitate the installation of speaker mesh 700 at the flare opening 430, a mounting groove can also be arranged on the periphery of the flare opening 430, and the speaker mesh 700 is installed on the base 400 through the mounting groove to cover the flare opening 430.

In addition, a supporting block 440 is arranged on the outer side of one end of the base 400 far away from the lamp body 100, and enables the speaker mesh 700 to be far away from the external supporting platform, so that the sound generated by the sound generator 600 can be better transmitted.

Refer to FIG. 3. In some embodiments, the water flow generator can be a water pump 200.

Specifically, a water inlet 110 and a water outlet communicating with the cavity 120 are respectively arranged on the lamp body 100. The water pump 200 is provided with a water inlet end and a water outlet end, the water inlet end communicates with the water inlet 110 (not marked in the figure), and the water outlet end communicates with the water outlet.

During operation, water in the cavity 120 enters the water pump 200 through the water inlet 110, and is then discharged to the cavity 120 through the water outlet end of the water pump 200 via the water outlet to realize water flowing in the cavity 120 as the water pump 200 has a certain pressure when discharging water, so that the jellyfishes in the cavity 120 can float up and down.

In other words, the ornamental lamp in the above embodiment only needs to be provided with the water inlet 110 and the water outlet 110 communicating with the cavity 120, the water inlet end of the water pump 200 communicates with the water inlet 110, and the water outlet end communicates with the water outlet to realize water flowing in the cavity 120 and make the jellyfishes float up and down. This method makes the structure of the whole ornamental lamp simpler, the service life of the water pump 200 is longer than that of the complex structure in the prior art, and the water pump 200 is more powerful so that the water flows faster.

Of course, in other embodiments, the structure of the water flow generator can also be arranged as follows: a motor is arranged outside the lamp body 100, a wind wheel is installed at the driving end of the motor, a magnet is arranged on the wind wheel, a wind blade is arranged in the cavity 120, a magnet is also arranged on the wind blade, and then the wind wheel drives the wind blade to rotate through the magnetic attraction relationship of the magnet to achieve water flowing.

Refer to FIG. 3. A bushing 130 can be also connected between the water outlet and the water outlet of the water pump 200. On the one hand, the bushing 130 enables the water pump 200 to accurately discharge water into the cavity 120; on the other hand, the bushing 130 enables water discharged by the water pump 200 to form a water column, which can speed up the water flow in the cavity 120 and make the water flow more stable.

Refer to FIG. 3. In order to facilitate the installation of water pump 200, an accommodating cavity (not marked in the figure) can be formed at one end of the lamp body 100, the water inlet 110 and the water outlet respectively communicate with the accommodating cavity, and the water pump 200 is arranged in the accommodating cavity.

Wherein, the water pump 200 can be IP68 waterproof water pump 200.

During operation, water in the cavity 120 enters the accommodating cavity through the water inlet 110, then water in the accommodating cavity enters the water pump 200 through the water inlet end of the water pump 200, and water in the water pump 200 is discharged to the cavity 120 through the bushing 130. In other words, in the above embodiment, the water pump 200 is completely immersed in the water of the accommodating cavity and can smoothly operate in the water as some specifications of water pump 200 can realize IP68 waterproofing, and the noise generated during operation of the water pump 200 can be reduced as the water pump 200 is located in the water.

Specifically, an accommodating groove 140 is formed integrally at one end of the lamp body 100, a stop piece 150 is arranged on the accommodating groove 140, the stop piece 150 and the accommodating groove 140 form the accommodating cavity, and the water inlet 110 and the water outlet are respectively arranged on the stop piece 150.

Specifically, the stop piece 150 can be connected with the lamp body 100 by snap fit, so that the stop piece is fixed on the accommodating groove to fix the water pump into the accommodating groove 140.

In addition, because the cavity 120 contains floating ornamental objects, the stop piece 150 can also prevent the ornamental objects from being sucked by the water pump.

In the above embodiments, an accommodating groove 140 is formed integrally at one end of the lamp body 100. For example, the lamp body 100 is concave outwards to form a concave structure, which is the accommodating groove 140, facilitating the installation of the water pump 200. At the same time, the openings of the concave structure can be used as the water inlet 110 and the water outlet, facilitating processing.

In addition, the accommodating groove 140 is formed integrally at one end of the lamp body 100, namely, the water pump 200 is substantially located inside the lamp body 100, so that an additional sealing waterproof structure is not required for the water pump 200 in the accommodating cavity to avoid the risk of leakage and make the structure simpler.

In addition, some side walls of the lamp body 100 are transparent or semitransparent, so the user can see the assembly structure of the water pump through the lamp body 100. Therefore, the integrally formed concave structure can avoid forming assembly holes and other structures at the end of the lamp body 100 and affecting the user's impression.

Refer to FIG. 3. In some embodiments, an LED lamp 300 is arranged outside one end of the lamp body 100 and irradiates toward the cavity 120, and the side wall at least corresponding to the LED lamp 300 area on the lamp body 100 is made of transparent material. Understandably, the LED lamp 300 irradiates toward the cavity 120 to make the ornamental objects in the cavity 120 such as jellyfishes show different colors, improving the ornamental value.

Specifically, the LED lamp 300 can be fixed in the mounting cavity 410.

In addition, a PCB (not marked in the figure) can also be arranged in the mounting cavity 410, and is electrically connected with the LED lamp 300, the water flow generator and the sound generator 600 to control the operation of the LED lamp 300, the water flow generator and the sound generator 600.

A button 500 can also be arranged on the side wall of the base 400, and the button 500 is connected with the PCB and controls the operation of the LED lamp 300, the water pump 200 and the sound generator 600 through the PCB.

Refer to FIG. 3. An opening can also be arranged on the lamp body 100, and a seal cover 160 is arranged detachably at the opening. Wherein, the seal cover 160 can be made of silicone material, which can improve the sealing performance. The opening facilitates filling of water and jellyfishes into the cavity 120.

In some embodiments, the opening can be arranged at one end away from the water pump 200, and the LED lamp 300 can be arranged at the end where the water pump 200 is located, which can prevent the opening from interfering with the LED lamp 300, the water pump 200 and other structures.

Specifically, in order to facilitate processing and assembly, the lamp body 100 can also comprise an upper cover 170*a*, a sleeve 170*b* and a lower cover 170*c*, wherein the upper cover 170*a* and the lower cover 170*c* are respectively arranged at both ends of the sleeve 170*b* to form a cavity 120 in the sleeve 170*b*.

Further, the sleeve 170*b* is transparent or semitransparent to facilitate the user to view the ornamental objects such as jellyfishes in the cavity 120.

The opening is arranged on the upper cover 170*a*, and the accommodating cavity is arranged on the lower cover 170*c*, that is to say, an accommodating groove 140 can be integrally formed on the lower cover 170*c*.

For assembly, first install the water pump 200 into the accommodating groove 140, and then cover the stop piece 150 in the accommodating groove 140, then connect the sleeve 170*b* with the lower cover 170*c*, and connect the upper cover 170*a* with the sleeve 170*b* to realize the assembly of the lamp body 100.

Even further, an assembly groove 180 is respectively arranged on the upper cover 170*a* and the lower cover 170*c*, the sleeve 170*b* is clamped in the assembly groove 180. The assembly groove 180 facilitates the connection between the sleeve 170*b* and upper cover 170*a* and between the sleeve 170*b* and the lower cover 170*c* respectively.

In addition, the LED lamp 300 can be located at one end of the lower cover 170*c* away from the sleeve 170*b*. At this time, the lower cover 170*c* can be made of transparent material on the whole.

The above are only better embodiments of the utility model and are not used to limit the utility model. Any modification or equivalent replacement and improvement made in the spirit and principle of some utility models shall be included within the scope of protection of some utility models.

The invention claimed is:

1. An ornamental lamp, characterized in that the ornamental lamp comprises:

a lamp body;

a water pump;

a lamp body, which is provided with a cavity, the cavity is used for holding liquid and ornamental objects, a water inlet and a water outlet communicating with the cavity are respectively arranged on the lamp body, at least part of the side wall of the lamp body is transparent or semitransparent;

a water pump, which is provided with a water inlet end and a water outlet end, the water inlet end communicates with the water inlet, and the water outlet end communicates with the water outlet;

wherein, the lamp body composes an accommodating cavity formed at one end of the lamp body, the water inlet and the water outlet respectively communicate with the accommodating cavity, and the water pump is arranged in the accommodating cavity;

wherein, the ornamental lamp composes of an accommodating groove formed integrally at one end of the lamp body and forms the accommodating cavity, and an opening on the accommodating groove forms the water inlet and the water outlet;

wherein, the ornamental lamp composes of a stop piece arranged on the accommodating groove, and the water inlet and the water outlet are respectively arranged on the stop piece.

2. An ornamental lamp according to claim 1, characterized in that the stop piece is connected with the lamp body by snap fit so that the stop piece is fixed on the accommodating groove.

3. An ornamental lamp according to any of claim 1, characterized in that the ornamental lamp also comprises a sound generator, which is arranged on one side of the side wall of the lamp body away from the cavity and is used to play sound.

4. An ornamental lamp according to claim 3, characterized in that the ornamental lamp also comprises a base, which is provided with a mounting cavity, the lamp body is arranged on the base, and the sound generator is arranged in the mounting cavity.

5. An ornamental lamp according to claim 4, characterized in that a fixing structure is also arranged on an inner side of the base away from the lamp body, the sound generator is arranged on the fixing structure, a flare opening is arranged at one end of the base away from the lamp body and corresponding to a position of the sound generator, and a speaker mesh is arranged at the flare opening.

6. An ornamental lamp according to any of claim 5, characterized in that an LED lamp is arranged outside one end of the lamp body and irradiates toward the cavity, and the side wall at least corresponding to the LED lamp area on the lamp body is transparent.

7. An ornamental lamp according to claim 6, characterized in that a supporting block is also arranged outside one end of the base away from the lamp body and enables the speaker mesh to be far away from an external supporting platform.

* * * * *